US010039968B2

(12) United States Patent
Becktell

(10) Patent No.: US 10,039,968 B2
(45) Date of Patent: Aug. 7, 2018

(54) TRAINING RACKET AND METHOD

(71) Applicant: Robert W Becktell, Hockley, TX (US)

(72) Inventor: Robert W Becktell, Hockley, TX (US)

( * ) Notice: Subject to any disclaimer, the term of this patent is extended or adjusted under 35 U.S.C. 154(b) by 120 days.

(21) Appl. No.: 15/145,308

(22) Filed: May 3, 2016

(65) Prior Publication Data

US 2017/0252629 A1 Sep. 7, 2017

Related U.S. Application Data

(63) Continuation-in-part of application No. 15/057,595, filed on Mar. 1, 2016.

(51) Int. Cl.
*A63B 69/38* (2006.01)

(52) U.S. Cl.
CPC ..... *A63B 69/38* (2013.01); *A63B 2208/0204* (2013.01)

(58) Field of Classification Search
CPC . A63B 69/38; A63B 49/02; A63B 2069/0008; A63B 2023/003; A63B 21/055; A63B 2208/0204
USPC ..... 482/140; D21/679, 799.1, 729; 473/463
See application file for complete search history.

(56) References Cited

U.S. PATENT DOCUMENTS 3,246,894 A * 4/1966 Salisbury ..... A63B 69/0002 473/256
3,820,781 A * 6/1974 Kane ..... A63B 21/0004 473/227
D256,824 S * 9/1980 Ward ..... 473/303
4,565,367 A * 1/1986 Kaiser ..... A63B 21/0004 482/121
4,565,371 A * 1/1986 Pawlicki ..... A63B 49/02 473/547
4,583,734 A * 4/1986 Pawlicki ..... A63B 49/02 473/524
4,770,414 A * 9/1988 Fredrickson ..... A63B 23/0211 482/148
4,863,158 A * 9/1989 Tassone ..... A63B 21/0004 482/106
D307,308 S * 4/1990 Cooper ..... D21/729
5,190,512 A * 3/1993 Curran ..... A63B 21/0004 482/122
5,230,506 A 7/1993 Ciprieno
5,312,314 A * 5/1994 Stephan ..... A63B 21/0602 482/106
5,700,205 A * 12/1997 Sanford ..... A63B 69/3632 473/232
6,022,300 A * 2/2000 Hightower ..... A63B 21/0724 482/106
6,129,650 A * 10/2000 Wedge, Jr. ..... A63B 71/0009 482/139

(Continued)

*Primary Examiner* — Raleigh W Chiu
(74) *Attorney, Agent, or Firm* — Kenneth L. Nash; Thomas D. Nash

(57) ABSTRACT

A training racket with a user end on one side and a hitting end on an opposite side. The user end further comprises a first grip, a second grip, and a generally u-shaped segment interconnecting the first grip and the second grip. The generally u-shaped segment extends away from an axis extending through the first grip, the second grip and the hitting end, whereby the player positions a portion of the racket behind their back with a first grip on one side of their body and the second grip on the opposite side of their body to practice their hitting and swinging techniques.

13 Claims, 5 Drawing Sheets

(56) References Cited

U.S. PATENT DOCUMENTS

| | | | | |
|---|---|---|---|---|
| 6,244,994 | B1 * | 6/2001 | Tilberis | A63B 21/0023 482/124 |
| 6,379,261 | B1 | 4/2002 | Hart | |
| D464,691 | S * | 10/2002 | Tracy | D21/679 |
| 6,554,718 | B2 * | 4/2003 | Back | A63B 69/0057 473/212 |
| 6,616,545 | B2 * | 9/2003 | Lacoste | A63B 53/007 473/248 |
| 7,041,017 | B1 | 5/2006 | Carfo | |
| 7,235,024 | B2 | 6/2007 | Lefebvre et al. | |
| 7,322,908 | B2 * | 1/2008 | DiGiacomo | A63B 21/0552 482/109 |
| 7,867,102 | B2 * | 1/2011 | Wallace | A63B 21/0552 473/220 |
| 7,935,011 | B1 * | 5/2011 | Krbec | A63B 69/38 473/463 |
| D676,912 | S * | 2/2013 | Lee | D21/757 |
| D685,865 | S * | 7/2013 | Kuhn | D21/679 |
| D728,039 | S * | 4/2015 | Groshek | D21/679 |
| D767,055 | S * | 9/2016 | Randle, Sr. | D21/725 |
| 2004/0002413 | A1 * | 1/2004 | Wimber | A63B 23/03575 482/140 |
| 2004/0033867 | A1 * | 2/2004 | Katami | A63B 23/03575 482/109 |
| 2006/0025246 | A1 | 2/2006 | Forney | |
| 2006/0199713 | A1 * | 9/2006 | Zuravel | A63B 21/00047 482/148 |
| 2007/0275788 | A1 * | 11/2007 | Delpine | A63B 69/0059 473/226 |
| 2009/0239675 | A1 * | 9/2009 | Wallace | A63B 21/0552 473/220 |
| 2012/0172157 | A1 | 7/2012 | McCrory | |
| 2017/0072247 | A1 * | 3/2017 | Wilson | G08B 3/10 |

* cited by examiner

TRAINING RACKET AND METHOD

This application is a continuation-in-part of U.S. application Ser. No. 15/057,595 filed Mar. 1, 2016, which is incorporated herein by reference.

BACKGROUND OF THE INVENTION

Field of the Invention

The present invention relates generally to swinging and hitting systems to teach hand eye coordination and proper swinging techniques and, more specifically, to a tennis racket with a receptacle or u-shaped portion in which to accommodate a torso of a user with grips on opposite sides of the receptacle.

Background of the Invention

Tennis is a popular sport among children, men, and women. Although popular, it does not mean that the sport is easy. Specifically, it can be difficult to properly swing a racket, while still maintaining eye contact on the ball during the swing. Oftentimes, the player does not have good enough hand eye coordination initially, and must work to hone this skill to properly wield a racket to hit the ball. More swing and hitting training may be needed as the player develops to reiterate the importance of fundamentals. Other issues affecting players include maintaining the proper balance during the swing, rhythm of the swing, proper plane of the swing, and proper hand placement on the racket.

Numerous attempts to produce a training racket that addresses these issues exist in the prior art. The following patents discuss background art related to the above discussed subject matter:

U.S. Pat. No. 5,230,506 issued Jul. 27, 1993, to Cipriano, discloses a sport training device having a hollow shaft into which is connected a flexible hollow rod which is secured to the shaft in such a manner that a region of the flexible hollow rod located inside of the shaft is separated by an air space from an interior wall of the shaft. A ball-shaped target is connected to the flexible hollow rod at the target end of the device. A rubber or rubber-like handle is attached to the shaft at the holding end of the training device.

U.S. Pat. No. 6,379,261 issued Apr. 30, 2002, to Hart, discloses a golf swing training and muscle exercising apparatus or swing trainer is provided which is designed to be used indoors as well as outdoors. The golf swing trainer includes a double bent shaft having upper and lower end portions separated by a center portion, the center portion being interconnected, at opposite ends thereof, with each of the upper and lower end portions by first and second joining portions. The upper and lower end portions are substantially straight and have respective center lines, wherein the center line for the upper end portion is the first center line, the center line for the center portion is the second center line and the center line for the lower end portion is the third center line, the first center line lying at an angle A to the second center line and the second center line lying at an angle B to the third center line. The first center line, second center line and third center line preferably lie in the same plane and angle B is preferably greater than angle A. The preferred golf swing trainers will include a training grip and a weighted head which is detachably engaged with the distal or lower end of the shaft. The weighted head will preferably weigh from about 0.25 to about 3.0 pounds.

U.S. Pat. No. 7,041,017, issued May 9, 2006, to Carfo, discloses a training aid for teaching batters how to swing properly. The aid resembles a baseball bat which has a front portion which has been flattened, and an angled device has been attached to the handle. The angled portion has a flat portion which is not quite parallel with the flat portion on the front of the bat.

U.S. Pat. No. 7,235,024, issued Jun. 26, 2007 to Lefebvre, et al., discloses a training bat having a handle portion with a knob end and a barrel receiving end, a hitting portion, and a means for tethering said handle portion to said hitting portion. The means for tethering is selected from an eye bolt assembly, a link assembly, or an eye bolt. The eye bolt assembly joins a wood fitting portion secured within the barrel receiving end of the handle portion to the hitting portion by one or more chain links, as well as joins a wood hitting portion to the one or more chain links. The link assembly joins a plug secured within the barrel receiving end of the handle portion to the hitting portion by one or more chain links.

U.S Patent Application No. 2006/0025246, published Feb. 2, 2006, to Forney, discloses a swing training including a bat body having a handle, a barrel and a tapered section joining the handle. The bat body is adapted for hitting a pitched ball. A locking grip is adjustably fixed to the handle and has a bottom end knob and a top end knob. A sliding grip is mounted on the handle and movable between the locking grip and the barrel. The sliding grip has a bottom end knob for stopping the movement of the sliding grip in the direction of the locking grip.

U.S Patent Application No. 2012/0172157 published Jul. 5, 2008, to McCrory, discloses a hand held baseball or Softball training device for assisting a batter in learning proper swing mechanics which include a light weight 1" hollow aluminum tube having two ends, a hand grip defining sleeve with a rubber stop disposed about the first end of the tube and a rubber cap on the second end, a lightweight aluminum oval sweet spot simulation component which is movable along the 1" hollow aluminum tube so as to prove a visual indication to the batter as to the flight of the ball after contact which determines the position that the wrist are when contact is made with the ball.

There exists a need for an improved hitting and swinging implement that addresses the problems discussed hereinbefore. Consequently, those skilled in the art will appreciate the present invention.

SUMMARY OF THE INVENTION

A primary object of the present invention is to provide an improved training racket for tennis players.

Another object of the present invention is to provide an improved training racket to teach hand eye coordination.

Yet another object of the present invention is to provide a training racket to improve a user's hitting and swinging by incorporating a receptacle to receive the user's body with a hand grip on opposite sides of the receptacle.

A further object of the present invention is to provide a training racket to improve a user's motion, rhythm, torso rotation, and hand placement during hitting.

These and other objects, features, and advantages of the present invention will become clear from the figures and description given hereinafter. It is understood that the objects listed above are not all inclusive and are only intended to aid in understanding the present invention, not to limit the bounds of the present invention in any way.

In one embodiment a training racket is provided for a player. The player comprising a body or torso. The training racket comprising a rigid elongate racket. A user end of the rigid elongate racket comprising a first grip, a second grip spaced apart from the first grip, and a U-shaped segment sized to receive the torso of the user. The first grip and the second grip are on opposite sides of the U-shaped segment. In this way, the second grip is positioned for gripping on an opposite side of the torso of the user from the first grip. A metal oval hitting end on the rigid elongate racket is opposite from the user end. If desired, the U-shaped segment may comprise slidable adjustments to accommodate different size users.

In accordance with the disclosure, one embodiment of a training tennis racket, as disclosed herein, may include, but is not limited to a rigid elongate metal tubular; a user end on one side of the rigid elongate metal tubular, the user end including a first grip on one side of the user end and a second grip axially offset from the first grip along the rigid elongate metal tubular; a hitting end on an opposite side of the rigid elongate metal tubular from the user end. In one embodiment, a straight axis extends through the first grip, the second grip and the hitting end. A generally u-shaped segment interconnects the first grip and the second grip. The generally u-shaped segment including a portion that extends away from the straight axis.

In one embodiment, the generally u-shaped segment further defines a generally semi-circular or oval shaped segment. In another embodiment, the generally u-shaped segment further includes a back plate, a first side, and a second side.

The generally u-shaped segment may further include a first interior angle and a second interior angle, whereby the first interior angle and the second interior angle are rounded. The first interior angle and the second interior angle may further include acute angles, obtuse angles, or an acute and an obtuse angle.

In another embodiment, a training tennis racket for a player is disclosed, including, but not limited to, a rigid elongate metal tubular; a first grip; a second grip; a hitting end on a side of the rigid elongate metal tubular opposite the first grip and the second grip; a player body receptacle positioned between the first grip and a second grip, the player body receptacle being generally u-shaped and configured to receive a body of a player. It further comprises a straight axis extending through the first grip, the second grip and the hitting end, the player body receptacle including at least a portion thereof that extends away from the straight axis. The player body receptacle may define a generally semi-circular or oval shaped segment.

In another embodiment, the player body receptacle may further include a back plate, a first side, and a second side. It may further include a first interior angle and a second interior angle, with the first interior angle and the second interior angle being rounded. The first interior angle and the second interior angle may have either acute angles, obtuse angles, or one of both an acute and an obtuse angle.

Another embodiment provides a method for making a training tennis racket, including: providing an elongate metal tubular; providing a user end on one side of the rigid elongate metal tubular, the user end including a first grip on one side of the user end and a second grip offset from the first grip along the rigid elongate metal tubular; providing a hitting end on an opposite side of the rigid elongate metal tubular from the user end.

Other steps may comprise providing a straight axis extending through the first grip, the second grip and the hitting end; and interconnecting a generally u-shaped segment between the first grip and the second grip, the generally u-shaped segment including a portion that extends away from the straight axis.

The method may further comprise providing that the generally u-shaped segment defines a generally semi-circular or oval shaped segment.

The method may provide the u-shaped segment further include a back plate, a first side, and a second side. The method may comprise providing the generally u-shaped segment further includes a rounded first interior angle and a second interior angle, the first interior angle and the second interior angle being rounded. The method may also include providing the first interior angle and the second interior angle include both acute angles, both obtuse angles, or one of both an acute and an obtuse angle training racket.

BRIEF DESCRIPTION OF THE DRAWINGS

The above general description and the following detailed description are merely illustrative of the generic invention, and additional modes, advantages, and particulars of this invention will be readily suggested to those skilled in the art without departing from the spirit and scope of the invention. A more complete understanding of the invention and many of the attendant advantages thereto will be readily appreciated by reference to the following detailed description when considered in conjunction with the accompanying drawings, wherein like reference numerals refer to like parts and wherein.

DETAILED DESCRIPTION OF THE INVENTION

Detailed descriptions of embodiments of the invention are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Racket 100, may be referenced interchangeably herein as a hitting aid, swinging aid, or training racket 100. In one embodiment, racket 100 may be comprised of aluminum, aluminum alloy, various metals or any other material suitable for hitting purposes. In alternate embodiments for younger users, racket 100 may further comprise a foam, stuffing, any soft composite material, or the like, wrapped around hitting portion 10. In one embodiment, hitting and swinging racket 100 is used in conjunction with suspended string 130 and ball 120 as depicted in FIGS. 3-6. While a suspended string is shown for ball 120 in one embodiment, it will be understood that the ball may be otherwise mounted or may be tossed/hit to the beginner by a teacher or a machine. In another embodiment, racket 100 may be used solely with ball 120 consistent with the teachings herein. In one possible embodiment, racket 100 is an elongated rigid tubular of a monolithic construction, while in alternate embodiments, racket 100 may be constructed of various individual pieces configured as one. In one embodiment, the tubular may be continuous along the entire length thereof.

Figure 1:
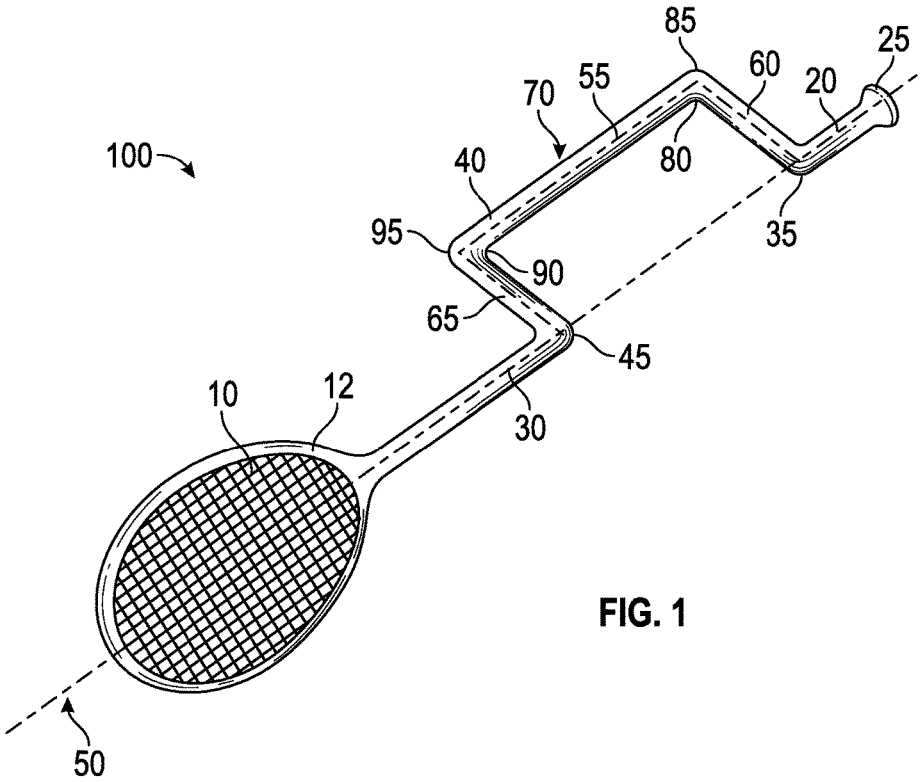
FIG. 1 is a perspective view of a hitting and swinging implement in accord with one possible embodiment of the present invention.
Figure 2:
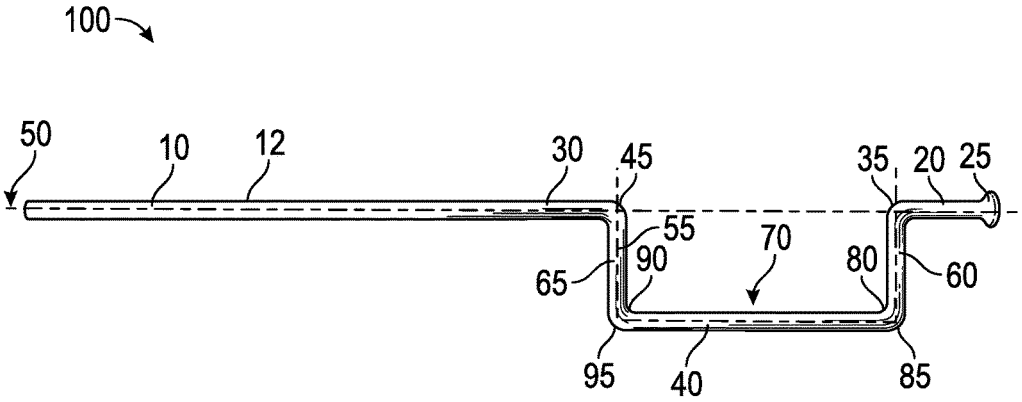
FIG. 2 is a side view of a hitting and swinging implement in accord with one possible embodiment of the present invention.

Looking to FIGS. 1 and 2, racket 100 is shown as a generally elongated rigid metallic tubular comprising hitting portion 10, second grip 30, u-shaped body portion 70, and first grip 20. In one embodiment, hitting portion 10, second grip 30, and first grip 20 are aligned along straight axis 50. However, in other embodiments these components may not necessarily be aligned. For example, in one possible embodiment first grip 20 might not be axially aligned with second grip 30. As well, portions of racket 100 may not be tubular, such as u-shaped body portion 70, which may also be referred to herein as u-shaped segment 70, receptacle 70, u-shaped body portion 70, or the like. For instance, u-shaped segment 70 could be padded and/or comprised of flat iron or plastic like material. One or more of the first or second hand grips may be shaped differently for gripping. The components may be coated or the like. U-shaped segment 70 may also comprise slidable portions to adjust the U-shaped segment size or addable/removable components for this purpose.

First grip 20 and second grip 30 may or may not be marked or otherwise distinguishable but are the portions where the hands of the player are naturally placed to utilize the racket in accordance with the hitting procedure shown in FIG. 3-FIG. 6. In this case, placing one hand on first grip 20 and the other hand on second grip 30 allow the user to readily hold receptacle 70 around the torso of the player. With the racket held in this position, the importance of swinging the hips during hitting is emphasized and reinforced. First grip 20 may be referred to as a first tubular portion in the claims. Second grip 30 may be referred to as a second tubular portion. These tubular portions are preferably oriented or parallel or axially aligned with each other and with hitting end 10 so as to be easily gripped by a user for purposes of placing the user in the hitting position shown in FIG. 3-FIG. 6 with the receptacle held around the body as explained with reference to FIG. 3. In one embodiment, receptacle 70 is around the back of the player's torso but conceivably could be around the front of the player's torso.

In one embodiment, hitting portion 10 is comprised of a set of strings in a grid attached under tension to racket frame 12 shaped like a traditional tennis racket with a generally oval frame. In other embodiments, hitting portion 10 may comprise a flattened or square face for striking ball 120. Receptacle 70 defines a generally u-shaped segment extending outwardly away from axis 50 interconnecting first grip 20 and second grip 30. First grip 20 is axially offset from second grip 30 along axis 50 on opposite sides of u-segment or receptacle 70. First grip 20 may further comprise grip end 25 to assist a user with keeping proper grip of racket 100. In this embodiment, u-shaped body portion 70 or receptacle is rectangular shaped and further comprises back plate 40 buttressed on a first side by first shoulder 60 and buttressed by second shoulder 65 on the opposite end with respect to first shoulder 60, whereby centerline 55 of u-shaped body portion 70 extends away from axis 50, around a user's back, and then returns to axis 50. In alternate embodiments, u-shaped body portion 70 may be semi-circular shaped, oblong shaped, or may comprise other shapes provided they are large enough to accommodate a user's body, consistent with the teachings herein.

As different users may be wider, taller, broader, and/or may have longer arms than other users, in various embodiments of training racket 100, u-shaped body portion 70, and more specifically back plate 40, shoulders 60 and 65 may be of all sizes and shapes to accommodate users of various sizes consistent with the teachings herein, provided they are in the proper proportions with respect to each other. U-shaped body portion 70 may comprise one or more length adjustment sections to adjust the lengths of components of U-shaped body portion 70 to fit different sized players.

In one alternate embodiment, back plate 40 may be curved, while first shoulder 60 and second shoulder 65 are of different lengths. In one embodiment, u-shaped segment or receptacle or body portion 70 may extend at least thirty percent around the torso of a player. In another embodiment, u-shaped segment or receptacle or body portion 70 may extend at least forty percent around the torso of a player. In another embodiment, u-shaped segment or receptacle or body portion 70 may extend at least fifty percent around the torso of a player. In another embodiment, u-shaped segment or receptacle or body portion 70 may extend at least sixty percent around the torso of a player.

In one embodiment, back plate 40, and shoulders 60, 65 are arranged so that hitting portion 10, first grip 20, and second grip 30 are aligned axially with respect to each other along axis 50. Hitting portion 10 may have a diameter equal to or greater than the diameter of first grip 20 and second grip 30. In one embodiment, the diameter of u-shaped body portion 70 is the same as first grip 20 and second grip 30. In one embodiment, hitting portion 10 has a diameter greater then u-shaped body portion 70.

In one embodiment, inner corners 80 and 90 are rounded 90 degree angles with respect to first shoulder 60, back plate 40, and second shoulder 65. Similarly, outer corners 95 and 85, as well as grip corners 35, 45 define rounded 90 degree angles. Inner corners 80 and 90 may add up to one-hundred eighty degrees. In alternate embodiments, inner corners 80 and 90, outer corners 85 and 95, and grip corners 35 and 45 may comprise angles more obtuse or acute with respect to those shown in FIGS. 1 and 2. In alternate embodiments, outer corners 85, 95 and inner corners 80, 90 may comprise sharp corners. In one embodiment, the size of inner corners 80, 90 is arranged so that hitting portion 10, first grip 20, and second grip 30 fall along axis 50 for training racket 100 to operate as intended.

Figure 3:
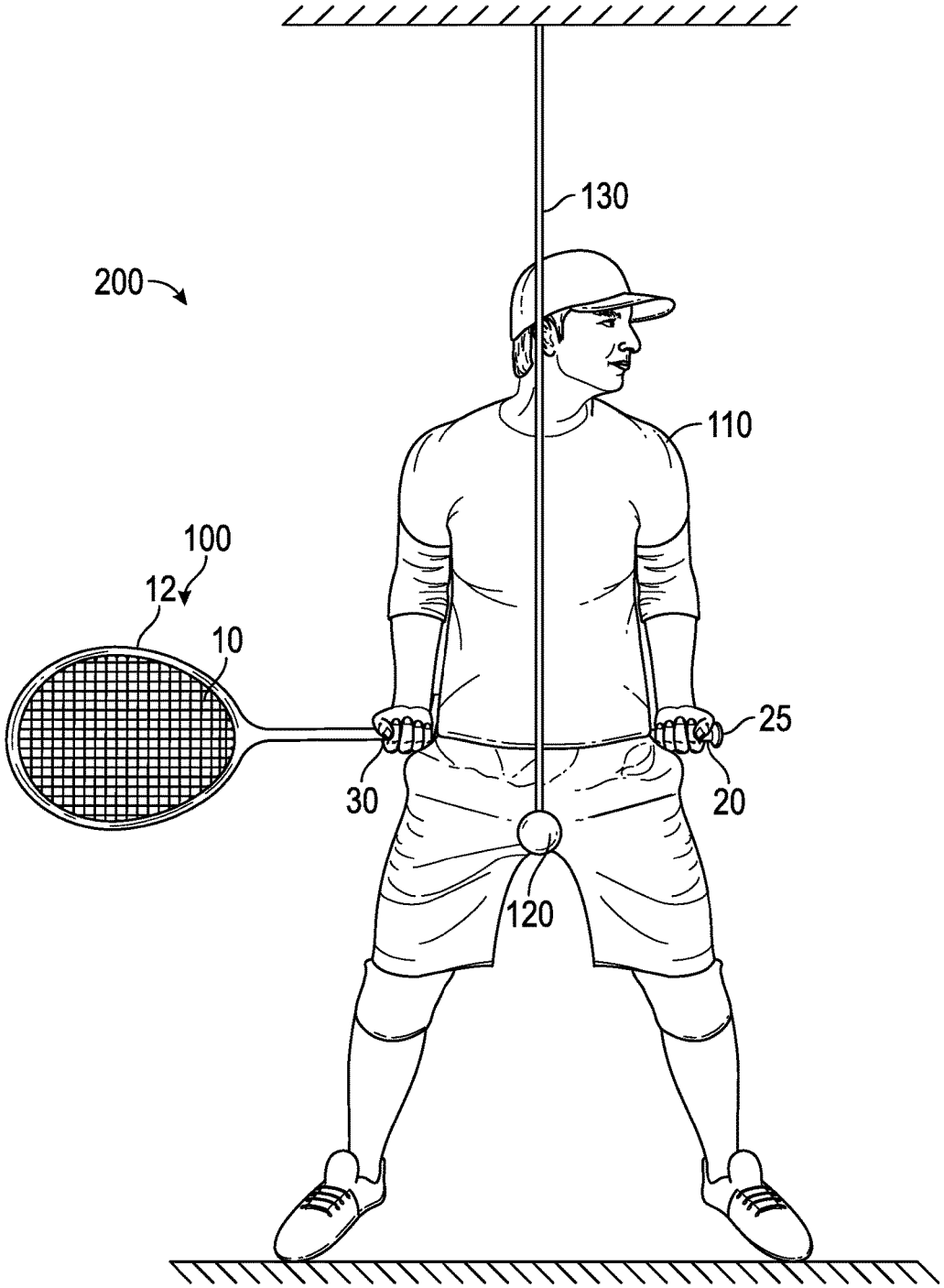
FIG. 3 is a side view of a hitting and swinging implement wielded by a user in a ready position in accord with one possible embodiment of the present invention.

Looking now to FIG. 3, user 110 is shown in beginning stance 200. User 110 is oriented within u-shaped body portion 70 around the back of the torso of the player with their palms forward with the left hand holding first grip 20 and the right hand holding second grip 30. However, other grips and stances may be utilized. In this embodiment, user or player 110 grips from beneath racket 100 so that the back of user 110 is adjacent back plate 40 with their body facing straight towards ball 120 suspended from string 130. Trainers can adjust the stance length, knee positions, and head placement of user 110 to best utilize racket 100.

Figure 4:
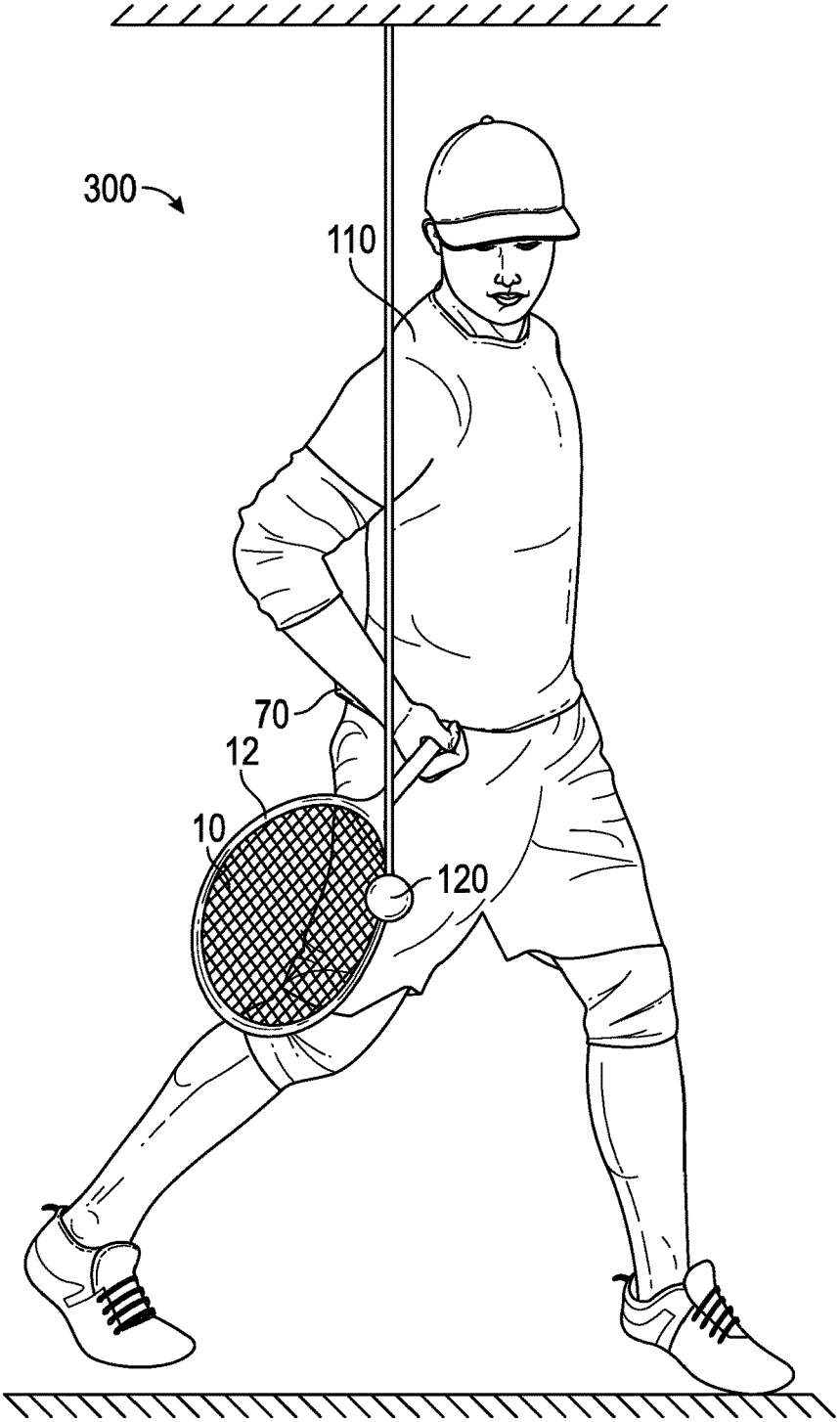
FIG. 4 is another side view of a hitting and swinging implement wielded by a user at the moment of contact with the ball in accord with one possible embodiment of the present invention.

FIG. 4 depicts user 110 in contact position 300, whereby user 110 pivots and turns their body towards the left from beginning stance 200 so that hitting portion 10 is on the proper plane to strike ball 120. Head remains focused on ball 120 during this portion of the swing and arms are bent at approximately a 45 degree angle with respect to racket 100.

Figure 5:
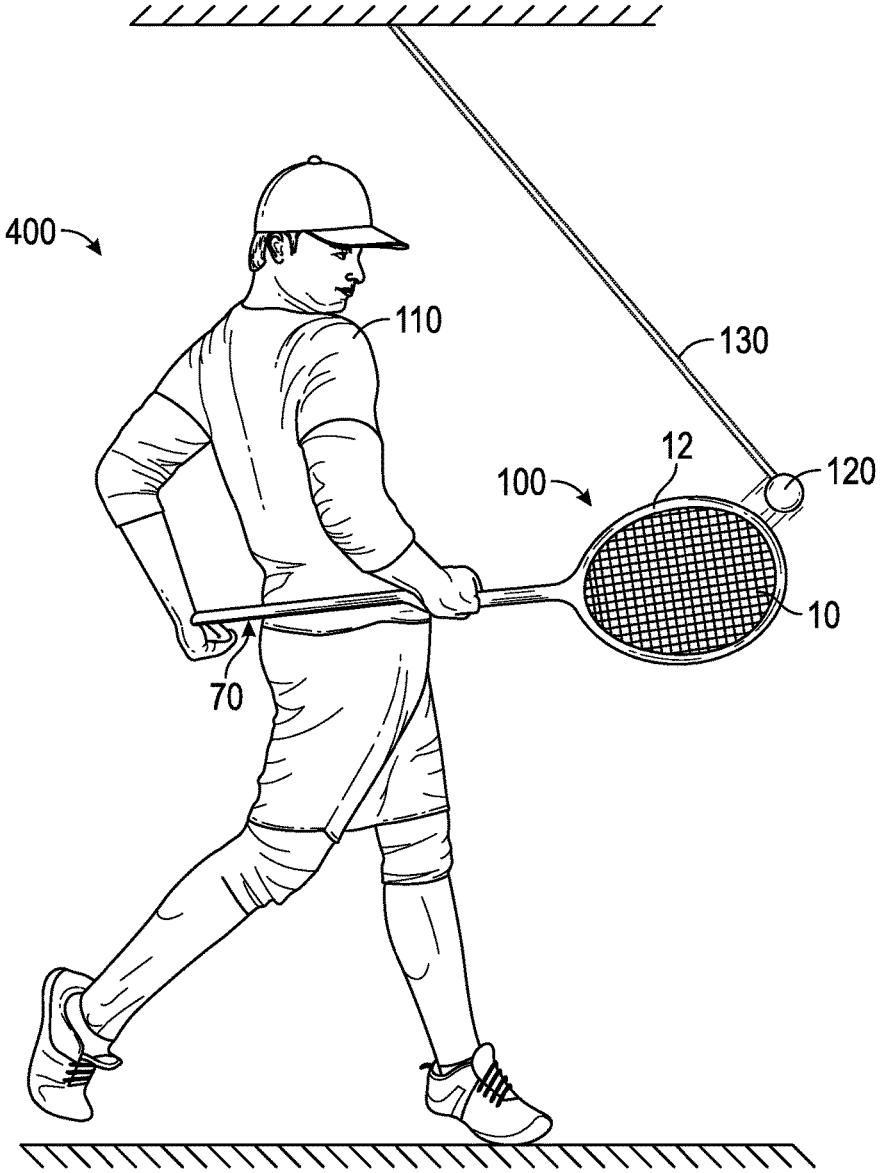
FIG. 5 is a side view of a hitting and swinging implement wielded by a user after contact with the ball in accord with one possible embodiment of the present invention.

In FIG. 5, user 110 has made contact with ball 120 and continues to pivot and turns their body towards the left with respect to the initial position of string 130. At this point of the swing, user 110 should continue rotating their body to the left, causing u-shaped body portion 70 to face more towards the initial position of string 130 than away from the initial position of string 130 with user 110 maintaining focus on ball 120 throughout the swing. It will be appreciated that in this embodiment u-shaped body portion 70 extends around at least forty and possibly fifty percent of the torso of the user or player 110.

Figure 6:
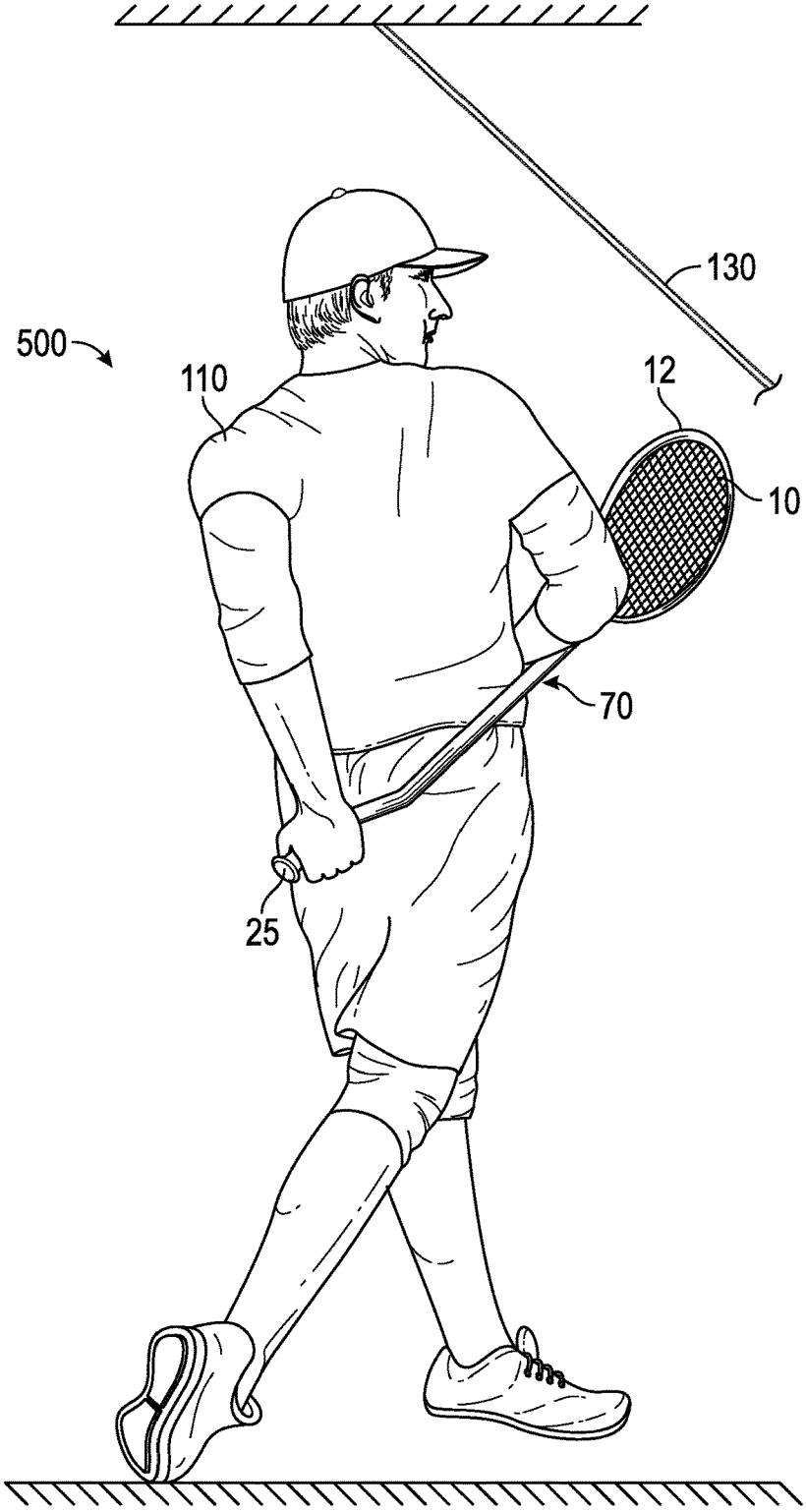
FIG. 6 is a side view of a hitting and swinging implement wielded by a user after full body extension after contacting the ball in accord with one possible embodiment of the present invention.

In FIG. 6, user 110 finishes the swing, having completely expended the momentum generated during the entire swing extending racket 100 as far around their body as practical. User 110 remains focused on ball 120 during this portion of the swing, with arms and body at full rotation with respect to beginning stance 200 in FIG. 3.

The foregoing description of embodiments of the invention has been presented for purposes of illustration and description only. It is not intended to be exhaustive or to limit the invention to the precise form disclosed; and obviously many modifications and variations are possible in light of the above teaching. Such modifications and variations that may be apparent to a person skilled in the art are intended to be included within the scope of this invention as defined by the accompanying claims.

The invention claimed is:

1. A training racket for use by a player for hitting a ball, comprising:

a rigid elongate racket;

a user end of said rigid elongate racket comprising a first grip;

a second grip spaced apart from said first grip;

a U-shaped segment sized to receive a torso of said player, said first grip and said second grip being on opposite sides of said U-shaped segment so that said second grip is positioned for gripping on an opposite side of said torso of said player from said first grip; and a hitting end on said rigid elongate racket opposite from said user end, said hitting end comprising a head and a neck, said head being substantially oval, said head configured to support strings spread across an entire width of said head in a plane, said neck positioned between said head and said user end.

2. The training racket of claim 1, further comprising said first grip and said second grip comprising each comprising a metal tubular structure.

3. The training racket of claim 2, wherein an axis of said hitting end extends through said first grip and said second grip, said U-shaped segment extending laterally away from said axis.

4. The training racket of claim 3, wherein said U-shaped segment extends around at least thirty percent of said torso of said player.

5. The training racket of claim 3, wherein said U-shaped segment comprises a back plate, a first side, and a second side.

6. The training racket of claim 4, wherein said U-shaped segment comprises a first interior angle and a second interior angle, said first interior angle and said second interior angle being rounded.

7. The training racket of claim 6, wherein said first interior angle and said second interior angle comprising a total of one hundred eighty degrees.

8. The training racket of claim 7, wherein said U-shaped segment is tubular with a centerline that extends away from said axis, said rigid elongate racket being tubular along an entire length thereof.

9. A training racket for use by a player for hitting a ball, comprising:

an elongate racket;

a first grip;

a second grip;

a hitting end on a side of said elongate racket opposite said first grip, said hitting end comprising a head, said head being substantially oval, said head configured to support strings spread across an entire width of said head in a plane; and a player body receptacle positioned between said first grip and said second grip, said player body receptacle being generally U-shaped to receive a torso of said player.

10. The training racket of claim 9, wherein said first grip and said second grip each comprise a metal tubular structure.

11. The training racket of claim 10, further comprising a straight axis extending through said first grip, said second grip and said hitting end, said player body receptacle comprising at least a portion that extends away from said straight axis.

12. The training racket of claim 11, wherein said player body receptacle comprises a back plate, a first side, and a second side, said player body receptacle comprises a first interior angle and a second interior angle, said first interior angle and said second interior angle being rounded, wherein said first interior angle and said second interior angle comprising a total of one hundred eighty degrees.

13. The training racket of claim 9, further comprising said elongate racket comprising a continuous metal tubular structure.

* * * * *